US007401937B2

(12) United States Patent
Abas

(10) Patent No.: US 7,401,937 B2
(45) Date of Patent: Jul. 22, 2008

(54) TRAFFIC GLOVES

(75) Inventor: Daniel A. Abas, Los Angeles, CA (US)

(73) Assignee: Traffic Gloves Corp., Los Angeles, CA (US)

( * ) Notice: Subject to any disclaimer, the term of this patent is extended or adjusted under 35 U.S.C. 154(b) by 1 day.

(21) Appl. No.: 11/243,208

(22) Filed: Oct. 3, 2005

(65) Prior Publication Data

US 2007/0076408 A1 Apr. 5, 2007

(51) Int. Cl.
*F21V 21/08* (2006.01)

(52) U.S. Cl. ..... 362/103; 362/84

(58) Field of Classification Search ..... 362/109, 362/103; 2/160

See application file for complete search history.

(56) References Cited

U.S. PATENT DOCUMENTS 5,245,516 A * 9/1993 de Haas et al. ..... 362/108
5,955,957 A * 9/1999 Calabrese et al. ..... 340/691.8
6,006,357 A * 12/1999 Mead ..... 2/160
6,709,142 B2 * 3/2004 Gyori ..... 362/554
6,711,746 B1 * 3/2004 Orellana ..... 2/160
6,722,771 B1 4/2004 Stephens
6,902,289 B1 * 6/2005 Smith ..... 362/103
7,013,490 B2 * 3/2006 Senter et al. ..... 2/160
7,055,978 B2 * 6/2006 Worthington ..... 362/103
7,152,248 B2 * 12/2006 Ziemer ..... 2/160

* cited by examiner

*Primary Examiner*—Anabel M Ton
(74) *Attorney, Agent, or Firm*—Blakely Sokoloff Taylor & Zafman LLP

(57) ABSTRACT

An apparatus that functions as a glove. The apparatus includes a glove adapted to receive a human hand, with areas suitable to fit a plurality of human fingers and a human thumb. In one embodiment, an elastic band comprises the wrist area of the glove, and is fitted to hold an electric inverter, which powers an electroluminescent wire. The electroluminescent wire may be connected to an exterior perimeter of the glove.

10 Claims, 4 Drawing Sheets

TRAFFIC GLOVES

BACKGROUND

Various devices and methods are used by municipal police and fire departments to direct traffic in the event of a traffic accident, natural catastrophe, or failed traffic signals. During the daytime, a police or traffic officer will typically use a whistle and hand signals with gloves to direct traffic. At nighttime when visibility is poorer, an officer will typically hold at least one flashlight to direct traffic while using hand signals with gloves.

From an officer's hand signals, drivers are often confused as to whether stop, slow down, or go through a particular intersection or segment of road. This same problem arises when officers are required to direct pedestrians. Further, if pedestrians are present and the officer is required to direct them in addition to traffic, the problem is compounded. Thus, there is a need to maximize transportation and pedestrian traffic direction by enhancing the visual and mental recognition of traffic instruction.

DETAILED DESCRIPTION

Figure 1:
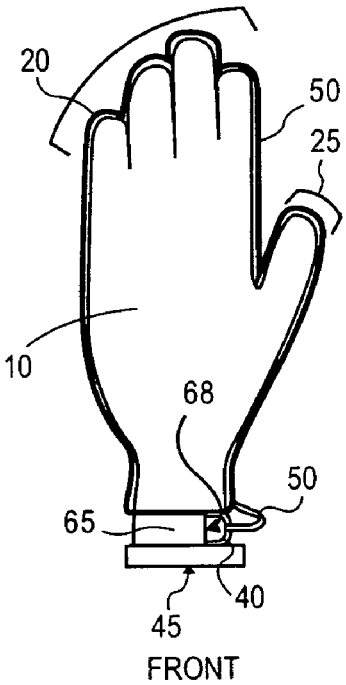
FIG. 1 is a top view of a first embodiment of an apparatus that may function as a traffic glove.
Figure 2:
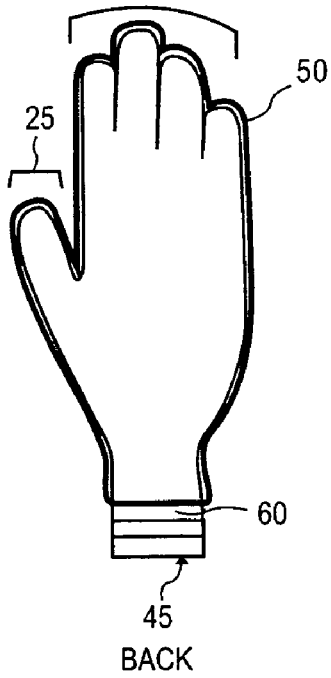
FIG. 2 is a bottom view of the apparatus of FIG. 1.
Figure 3:
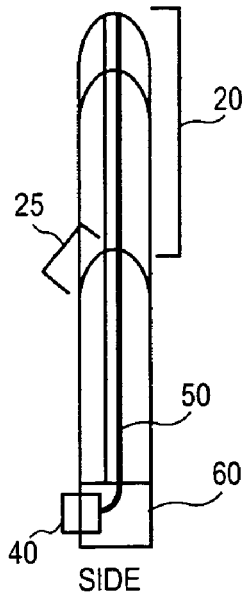
FIG. 3 is a side view of the apparatus of FIG. 1.

FIGS. 1-4 show one embodiment of an apparatus that may representably be worn as a glove and used to direct, control and/or manage traffic, including vehicular traffic. Referring to FIG. 1 and FIG. 2, glove 10 has a shape, size and configuration to be worn on a human hand (e.g., an adult human hand). In one embodiment, glove 10 has an exterior portion made of weatherproof vinyl material. However, it should be noted that any durable material sufficient to make-up a glove for a human hand may be used as an exterior portion. In an embodiment of a weatherproof vinyl material as an exterior portion, glove 10 may also optionally include an interior portion or lining of material such as cotton, which is primarily used to increase the comfort of wearing the glove. It should be noted here that any suitable cloth material may be used in lieu of cotton as an interior portion, if any.

In one embodiment, the internal volume of glove 10 is sufficiently large to allow a user already wearing a glove to fit glove 10 over the worn glove. For example, police officers or traffic officers often wear gloves as part of their uniform or to protect their hands from the elements. These gloves are often sized and formed to fit tightly against the skin of the hand on which they are worn. Gloves are typically sized by taking the larger of the measurement around the hand at the fullest part, excluding the thumb, and the measurement from the tip of the middle finger to the base of the hand. Men's size gloves typically range from seven to 12 inches. Thus, in one embodiment, glove 10 is at least sized to be an inch or two greater than a glove sized to fit a hand.

In the embodiment shown in FIGS. 1-4, glove 10 has a portion for fingers, a palm portion and a cuff portion. The portion for fingers may be divided into first finger portion 20 and second thumb portion 25 that define regions where fingers and a thumb, respectively, of a human hand may fit. In one embodiment, a human hand (e.g., a gloved hand) is inserted through opening 45 at a base of the cuff portion of glove 10. Note in this embodiment that first finger portion 20 does not envelope the full length of a respective human finger but only segments individual fingers at a top portion (e.g., an inch or two) of first finger portion 20 (as viewed) in FIGS. 1 and 2. Second thumb portion 25 envelopes the entire length of a human thumb when glove 10 is worn.

Figure 4:
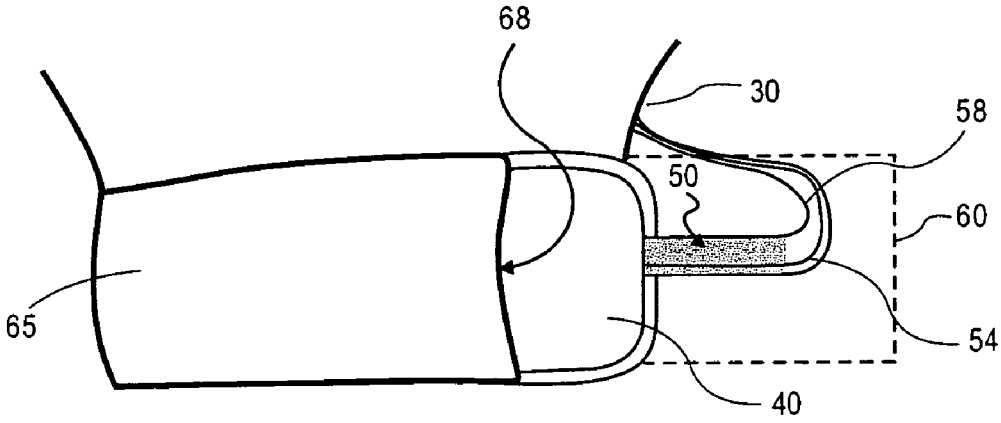
FIG. 4 is a view of the wrist area of FIG. 1.

Referring to FIG. 4, elastic band 60 is disposed around an exterior surface of the cuff of glove 10 and traverses the diameter of the exterior surface to define a cuff portion and form opening 45. In one embodiment, elastic band 60 is made out of a cotton fabric with an incorporated elastic band sewn into the vinyl material at an elastic tension around the cuff portion of glove 10. A front or palm side (FIG. 1) of glove 10 also includes pocket 65 of, for example, a weather proof vinyl having opening 68 optionally with an elastic material sewn into the end of pocket 65 (adjacent opening 68). In one embodiment, pocket 65 is sized to contain or substantially (e.g., ¾ or more) contain electric inverter 40. In one embodiment, electric inverter 40 is fitted into opening 68 of pocket 65. As viewed in FIG. 1, part of electric inverter 40 protrudes from opening 68 of pocket 65. Electric inverter 40 powers a light source surrounding a periphery of glove 10.

Connected around a perimeter of glove 10, from the cuff, around the palm portion and around the first portion and the second portion for the fingers, is a light source powered by electric inverter 40. In one embodiment, a suitable light source is an electroluminescent wire ("El wire"). FIGS. 1-4 show electroluminescent wire 50 connected to electric inverter 40 around a perimeter of glove 10. In one embodiment, electroluminescent wire 50 includes wire 54 (e.g., a 3.2 millimeter wire) wrapped in skin 54. Electroluminescent wire 50 may be connected to the exterior portion of glove 10 by stitching wire 50 to the exterior portion of glove 10 through skin 58. Alternatively, a lining material may be used to hold electroluminescent wire 50 onto the exterior surface of the glove, such as transparent (e.g., vinyl) pocket formed around the perimeter of glove 10 The pocket would be sized such that electroluminescent wire 50 could be deposited into the lining material.

In one embodiment, electroluminescent wire 50 is a light source based on the technology of electroluminescence. Electroluminescent wire is a linear light source in the form of a wire, which is produced in many colors, small diameters, and continuous lengths varying from inches to thousands of feet. In one embodiment, electroluminescent wire 50 is attached to one end of electric inverter 40. Electric inverter 40 is an electric device operated by DC voltage. Electric inverter 40 converts continuous DC voltage into changing AC voltage that, in this embodiment, is necessary for operating electroluminescent wire 50. Inverter 40 may include a manually operated switch to turn the power on/off to electroluminescent wire 50 and optionally to switch between a continuous signal and a pulsed signal.

Electroluminescent wire 50 acts as a capacitor, with capacitance being proportional to the length. Given a constant voltage, power consumption is proportional to frequency, and light output is roughly proportional to frequency. As a result, the intensity of light from electroluminescent wire 50 increases when the voltage, frequency, or both increases. In one embodiment, a range of voltages that electroluminescent wire 50 operates at is 50 volts alternating current ("VAC") to 130 VAC (RMS). The range of frequencies of electroluminescent wire 50 is virtually unlimited, and a common frequency at 50 to 5000 hertz. It is to be appreciated that the operating frequencies and voltages of electroluminescent wires are only indicative of the current state in the art. To power electroluminescent wire 50, electric inverter 40 may come in combinations involving low power and low frequency, low power and high frequency, high power and low frequency, and high power and high frequency, respectively. In one embodiment, electric inverter 40 uses one or two "AA" battery(ies) as a power source. Other power sources may also be suitable, including but not limited to coin-cell batteries and solar power (e.g., a solar power cell connected to the cuff).

Color for the use of gloves in traffic direction, control and/or management will be incorporated into an embodiment of the gloves as means of non-verbal communication. As current traffic signals utilize GREEN, YELLOW and RED as a means of non-verbal communication, gloves will maximize their visibility and established recognition to maximize the users direction of traffic. Different colors evoke different emotions in humans. "Red" generally symbolizes danger or warning, making it a good choice for "stop." "Green" is calming, probably most likely because it is prolific in nature and a sign of health and abundance, so it might have lent itself to mean "go." Curiously, yellow or amber, is associated with warmth, happiness, and the sun. Despite these connotations, it is chosen to symbolize "caution." This is due because it contrasts well with green and red, and is highly visible without being too harsh on the eyes of motorists. Today, yellow is commonly used as a warning symbol for both traffic signs and alert systems.

In one embodiment, color is used in the exterior (e.g., vinyl) material of the gloves, as well as for the corresponding color of the El Wire or other light source that is connected to the glove. Representatively, skin 54 of wire 50 in FIGS. 1-4 may be colored to match the color of the exterior material of glove 10.

| Color Specifications: | | | |
|---|---|---|---|
| RED: | R: 255 | G: 52 | B: 37 |
| GREEN: | R: 76 | G: 187 | B: 119 |
| YELLOW: | R: 255 | G: 237 | B: 83 |

In one embodiment, a glove such as glove 10 incorporates a colored material for the glove body and a corresponding colored light (e.g., El wire, LED, other light source). For example, a glove that may be used to direct, control and/or manage traffic may include a body of a RED, GREEN or YELLOW colored material. That glove will have a corresponding RED, GREEN or YELLOW light source connected for example along a glove perimeter as described above. It is believed the correspondence of color will maximize transportation and pedestrian traffic direction. Rather than directing traffic with a non-colored and indistinguishable pair of gloves, this embodiment, a pair of gloves are formed that utilize the recognition of color and luminosity to enhance traffic instruction.

A kit for use in directing/controlling traffic, in one embodiment, may include a pair of gloves. A pair of gloves refers to two actual gloves being sold or used as one pair (one for a left hand and one for a right hand). Therefore, in one embodiment, a kit includes a pair of gloves of one GREEN glove and one RED glove. In addition to this pair of gloves, another pair of a kit may include one YELLOW glove and one RED glove.

The following paragraphs describe one method of forming a glove such as glove 10.

Step 1: Pattern—Carefully trace a template of a hand onto the vinyl colored material using a light colored pencil. Fold the vinyl material over itself to cut through two layers. That way the mirror image of the pattern will already be ready for sewing. Once the pattern is created and the vinyl is double folded, carefully cut out the pattern. Remove the excess materials, separate both layers of the mirrored vinyl material.

Step 2: El Wire—An electroluminescence wire ("El wire") may be purchased including a "skin" connected to the wire. Utilizing this skin, cut the skin in areas where curves will be present allowing for more flexibility with the materials. A few snips here and there will ensure an easier stitching process. Make sure that the El wire color you are using corresponds to the same color as the vinyl material that has been cut as explained in Step 1. Before stitching, also make sure that the inverter of the El wire is fully functional, you may want to test the unit with batteries to make sure that it is working prior to stitching.

Step 3: Stitching—Take both sides of the vinyl material and flip them over so that the exteriors of the vinyl are back to back (the inner lining of the material should be visible face up). In between these two layers, stitch the El wire skin into the vinyl starting from a point at the base of the palm portion (opposite the second finger portion (see FIGS. 1-2)) using a durable thread material and needle. The El wire is pointed inwards, the opposite direction of the needle (this is done to ensure that once the glove is flipped inside out, the wire will be visible upon the outside of the Glove). Continue to stitch around the outlining of the fingers in the first portion (see FIGS. 1-2), and follow through to the base of the palm portion below the second finger portion (see FIGS. 1-2).

Step 4: Elastic Band—While the Glove is still flipped inside out, stitch the elastic band into the vinyl material at the base of the palm portion (at the top of the wrist) to form the cuff portion. A pocket (e.g., pocket 65) may be sewed into the band before or after attaching the band to the glove. The band will already have a slot open from one end allowing room for the inverter to be placed. Complete the stitching of the elastic band around the entire vinyl material encompassing the wrist until it is nice and snug.

Step 5: Flip/Inside Outside—Once the stitching is completed, you can flip the glove inside out. The exterior of the glove and the corresponding El wire light is exposed. All of the stitching will be concealed in the inner side of the glove.

Step 6: Adjustments—Adjustments may be made where they seem fit. In particular, there may be a slight excess of El wire. In addition, the elastic band may need adjusting or the El wire skin re-stitching if there is any thread showing.

Gloves such as described can be utilized in an array of circumstances. In applications related to traffic, whether it is an inoperable traffic light, construction traffic control, a broken down car on the freeway or parking attendants directing customers, one or more gloves offer a fast and easy solution to direct, control, or manage traffic safely and effectively.

The gloves are durable, easy to transport and can be worn over existing gloves to be used in any weather. Simply slip on the Gloves, turn on the power and direct traffic with confidence.

In one embodiment, the gloves are one of two variations: 1 Red 1 Green=pair or 1 Yellow 1 Red=pair. The variations work in the same way.

Initially, the concealed El wire inverter must be removed from the inside of the elastic band. Take off the cover for the batteries and place two "AA" batteries inside of the inverter. The inverter should be switched to the "on" position and returned to the pocket in the elastic band. In one embodiment, the inverter provides a control to switch the to a constant light or to pulse the light rapidly on and off. Typically, El wire has a battery life of approximately 12 hours on the "pulse" position and a battery life of 10 hours on the "on" position.

The gloves described herein may be worn on the naked hand, or on top of another pair of gloves. To wear the gloves, a user's fingers are flatten and inserted into a glove. This step is repeated with the second glove on a second hand. With one or both gloves on, and the light source optionally on, the user may begin directing, controlling or managing traffic much in the way the user would do with basic white cloth gloves. At any point, a user remove one glove to turn on, off or pulse the inverter on that glove. Alternatively, a switch for an inverter on a glove may be operated when a glove is on each hand of a user, for example, when a switch is exposed from pocket 65.

Figure 5:
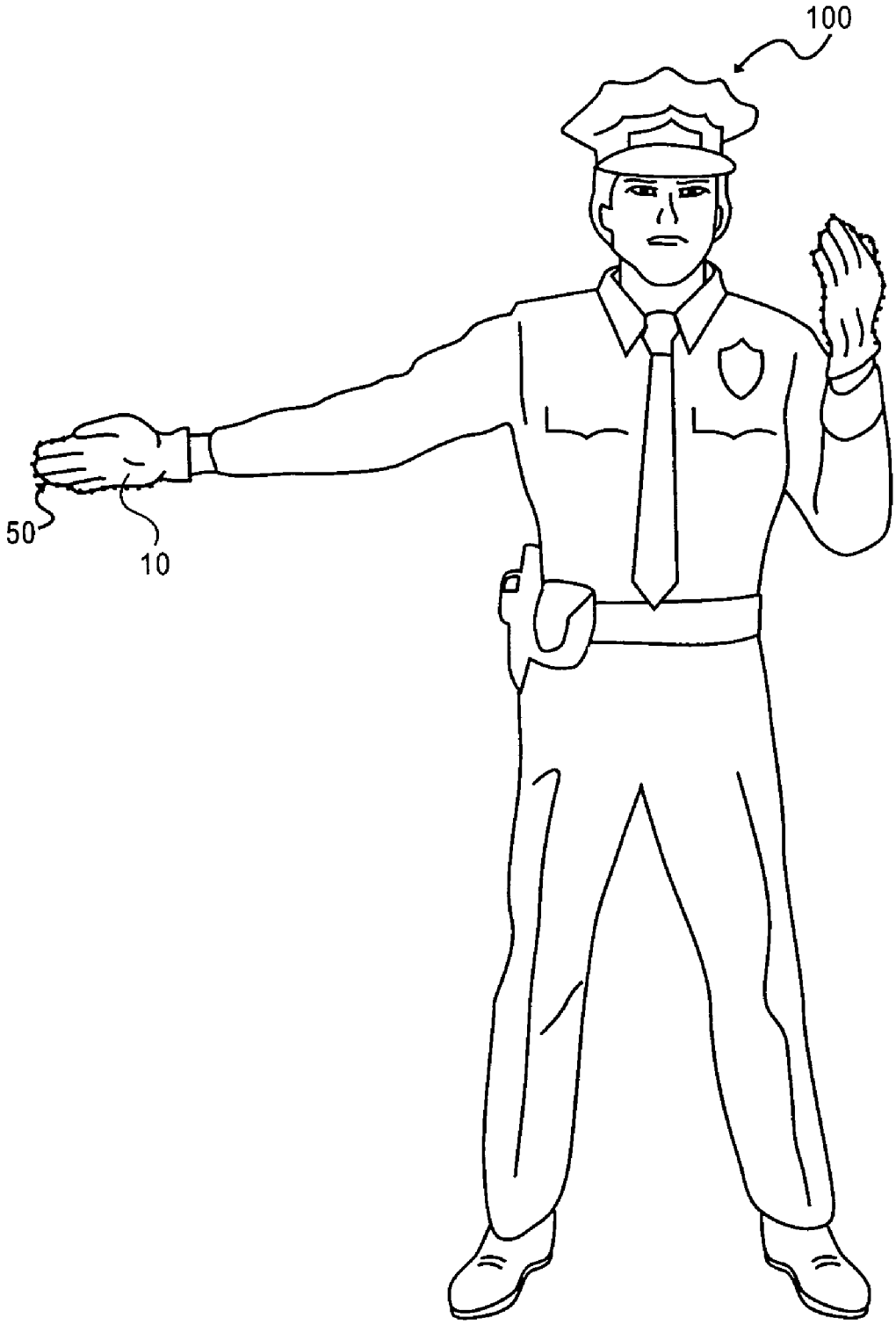
FIG. 5 is a method of using the apparatus of FIG. 1.

FIG. 5 discloses a method of wearing the glove with the light source powered to illumination with a human directing traffic using the glove. FIG. 5 shows officer 100 having a pair of gloves (one on each hand) directing vehicular traffic in a city street (e.g., directing vehicles to make a left turn). It is appreciated that, although an officer is shown, for example, directing traffic, other applications are also contemplated. For example, embodiments of gloves described herein may be used in commercial settings such as to direct traffic or pedestrians by valets or event attendants, or to direct construction equipment or personnel at construction sites. Embodiments of the gloves may also be supplied in vehicles (e.g., commercial trucks or passenger cars) as an emergency aid for use by a driver of the vehicle in the event of a stall or accident.

Figure 6:
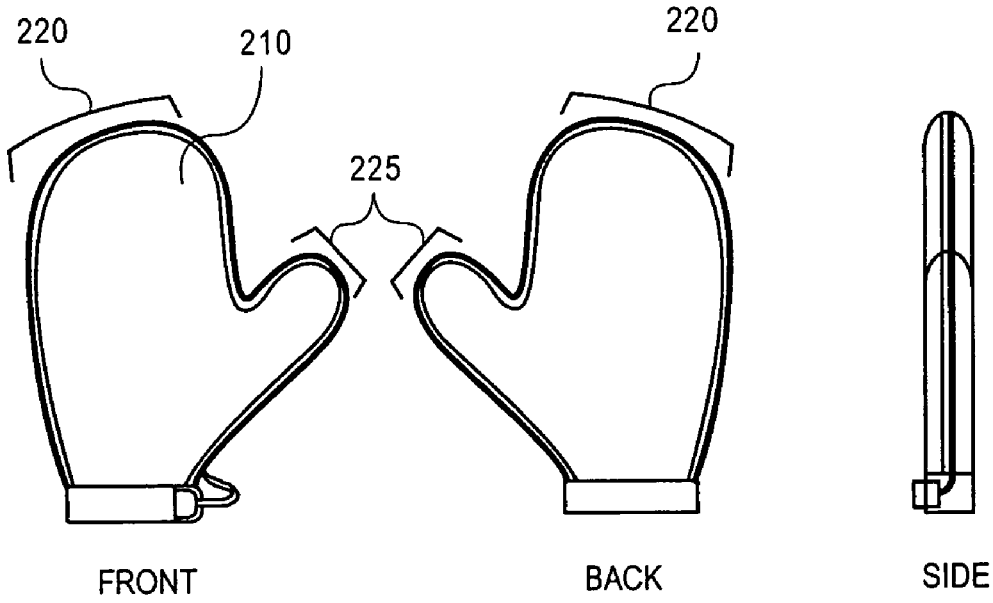
FIG. 6 is a top view of a second embodiment of an apparatus that may function as a traffic glove.

In addition to the configuration described above with reference to FIGS. 1-5, other glove embodiments are also contemplated. FIG. 6 discloses another embodiment of a glove exhibiting a mitten shape. In this embodiment, glove 210 has a portion 220 to encapsulate the entire length of the fingers of a human hand and a separate portion 225 to encapsulate a thumb of a human hand. Glove 210 also includes electroluminescent wire 250 or other light source disposed around the perimeter of the glove including around portion 220 and portion 225.

Figure 7:
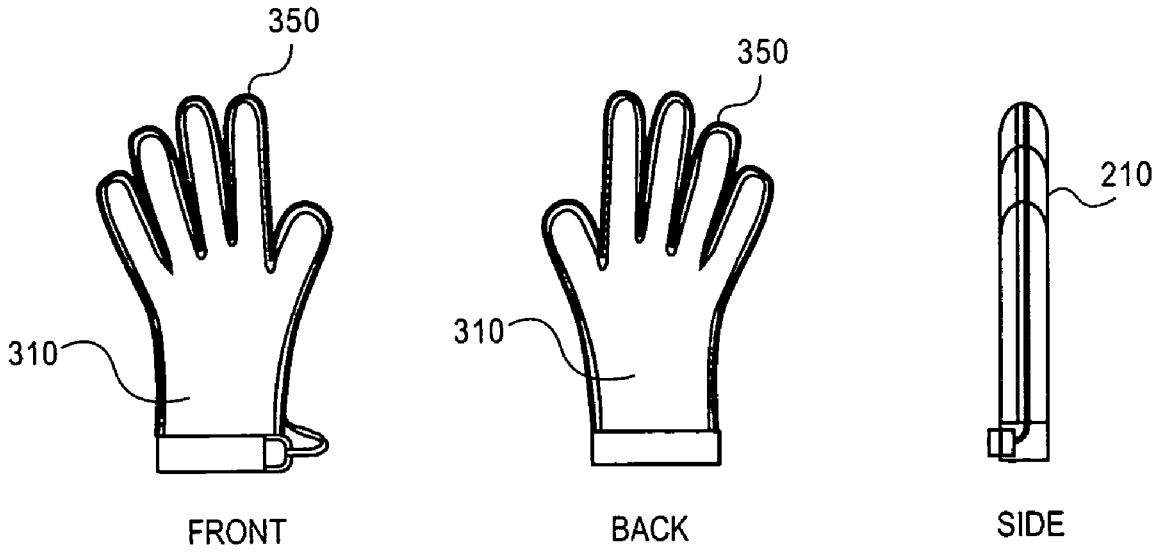
FIG. 7 is a top view of a third embodiment of an apparatus that may function as a traffic glove.

FIG. 7 is an embodiment with a shape in the form of an outline of a human hand. In this embodiment, specific finger portions are set off so that when glove 310 is worn, the fingers do not come in contact with each other inside the glove. FIG. 7 shows electroluminescent wire 350 extending along the perimeter of glove 310 including the perimeter of each finger and the thumb portion of the glove.

Figure 8:
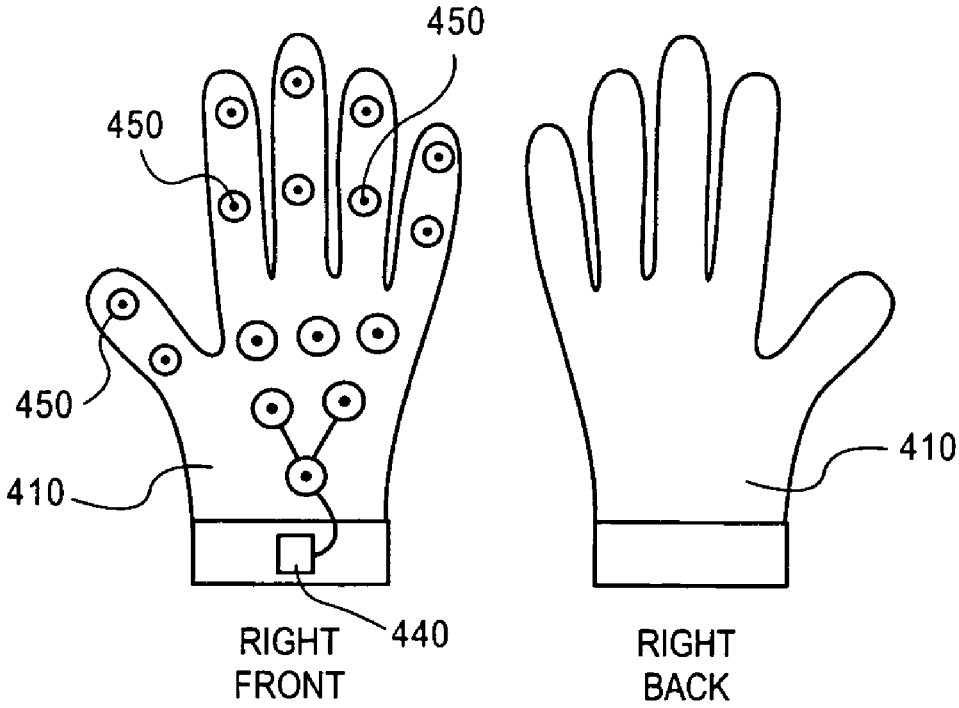
FIG. 8 is a top view of a fourth embodiment of an apparatus that may function as a traffic glove.

FIG. 8 discloses an embodiment of a glove where the light source comprises LED lights. Glove 410 exhibits a shape resembling the outline of a human hand. On one exterior side of glove 410 e.g., a front or palm side), glove 410 includes a number of light emitting diodes (LEDs) 410 connected to glove 410. FIG. 8 shows a front (palm) side of glove 410 having a number of LEDs connected to glove 410 including at palm, finger and thumb portions. LEDs may be magnetized, clipped or sewn on glove 410 and wired to inverter 440 in, for example, a cuff portion of glove 410.

Figure 9:
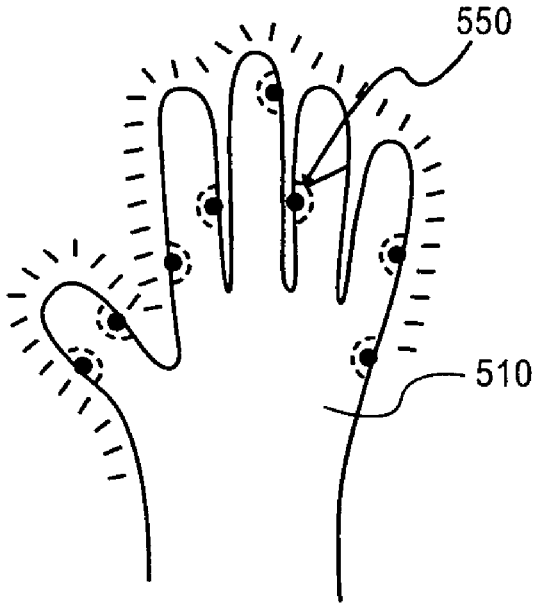
FIG. 9 is a top view of a fifth embodiment of an apparatus that may function as a traffic glove.

FIG. 9 disclose another embodiment of a glove where the light source includes LEDs or other light sources. FIG. 9 shows an embodiment where glove 510 includes one or more LEDs 550 connected to the interior of the glove to give the entire glove a glowing effect when LEDs or other light sources 550 are powered.

In the preceding detailed description, reference is made to specific embodiments thereof. It will, however, be evident that various modifications and changes may be made thereto without departing from the broader spirit and scope of the following claims. The specification and drawings are, accordingly, to be regarded in an illustrative rather than a restrictive sense.

What is claimed is:

1. An apparatus comprising:

a glove comprising a main portion that at least approximates the size and shape of a human hand, the main portion having an exterior and interior surface, the main portion substantially surrounding the palmar and dorsal portions of a human hand when the glove is worn, and an opening at the base of the main portion that is adapted to receive a human hand;

a light source comprising an electroluminescent wire;

an electrical inverter; and a lining material coupled to an exterior surface of the glove around a perimeter of the glove and defining a lumen therethrough, wherein the electroluminescent wire is attached to the electric inverter at one end of the electroluminescent wire and the electroluminescent wire is disposed in the lining material through the length of the lumen.

2. The apparatus of claim 1, wherein the electric inverter is adapted to receive at least one battery, the electric inverter having at least one battery as a power source.

3. The apparatus of claim 2, wherein the electric inverter is adapted to receive at least one coin-cell battery, the electric inverter having at least one coin-cell battery as a power source.

4. The apparatus of claim 1, wherein the main portion of the glove comprises a first portion, a second portion, and a third portion, the first portion having dimensions suitable for a plurality of fingers of a human hand to be inserted therethrough and extending from a first area of the third portion, and the second portion having a dimension large enough so that a thumb of a human may be inserted therethrough and extending from a different second area of the third portion, and wherein the lining material is coupled to the perimeter length of the exterior surface of the main portion beginning from one end of the opening of the main portion, positioned such as to extend over the first portion and the second portion, and ending at the opposite end of the opening of the main portion.

5. The apparatus of claim 1, wherein the main portion of the glove comprises a first portion, a second portion, and a third portion, the first portion defining a closed area for containing at least a distal portion of individual ones of human fingers, and the second portion defining a closed area for containing a human thumb, wherein the closed area for the human thumb is postured distal to the area containing the human fingers, and wherein the lining material is coupled to the perimeter length of the exterior surface of the main portion beginning from one end of the opening of the main portion, positioned such as to extend over the first portion and the second portions, and ending at the opposite end of the opening of the main portion.

6. The apparatus of claim 1, wherein the main portion of the glove comprises a first portion, a second portion, and a third portion, the first portion having dimensions suitable for the length of a respective finger of a human hand to be inserted therethrough and extending from a first area of the third portion, and the second portion having dimensions suitable for the length of a human thumb to be inserted therethrough and extending from a different second area of the third portion, and wherein the lining material is coupled to the perimeter length of the exterior surface of the main portion beginning from one end of the opening of the main portion, positioned such as to extend over the first portion and the second portion, and ending at the opposite end of the opening of the main portion.

7. An apparatus comprising:

a glove comprising a main portion that at least approximates the size and shape of a human hand, the main portion having an exterior and interior surface, the main portion substantially surrounding the palmar and dorsal portions of a human hand when the glove is worn, and an opening at the base of the main portion that is adapted to receive a human hand; and at least one light source coupled to the main portion such that a light from the light source is visible from both a palmar side and a dorsal side of the glove, wherein the main portion of the glove comprises a first portion, a second portion, and a third portion, the first portion having dimensions suitable for the length of a respective finger of a human hand to be inserted therethrough and extending from a first area of the third portion, and the second portion having dimensions suitable for the length of a human thumb to be inserted therethrough and extending from a different second area of the third portion, and wherein the light source comprises at least one LED coupled to a LED magnet, the LED having a power source, and the LED magnet attached to the exterior surface of the main portion.

8. An apparatus comprising:

a glove comprising a main portion that at least approximates the size and shape of a human hand, the main portion having an exterior and interior surface, the main portion substantially surrounding the palmar and dorsal portions of a human hand when the glove is worn, and an opening at the base of the main portion that is adapted to receive a human hand; and at least one light source coupled to the main portion such that a light from the light source is visible from both a palmar side and a dorsal side of the glove, wherein the main portion of the glove comprises a first portion, a second portion, and a third portion, the first portion having dimensions suitable for the length of a respective finger of a human hand to be inserted therethrough and extending from a first area of the third portion, and the second portion having dimensions suitable for the length of a human thumb to be inserted therethrough and extending from a different second area of the third portion, and wherein the light source comprises at least one LED coupled to a LED magnet, the LED having a power source, and the LED magnet attached to the interior surface of the main portion.

9. The apparatus of claim 1, wherein a color for the glove and a color for the lining material are similar.

10. The apparatus of claim 9, wherein the color for the glove and the color for the lining material each resemble a color of a traffic signal.

* * * * *